US006860577B2

(12) United States Patent
Choi

(10) Patent No.: US 6,860,577 B2
(45) Date of Patent: Mar. 1, 2005

(54) DEVICE FOR PREVENTING PRINTER HEADER FROM OVERHEATING

(75) Inventor: Kyung-chool Choi, Suwon (KR)

(73) Assignee: Samsung Electronics Co., LTD, Suwon-Si (KR)

( * ) Notice: Subject to any disclaimer, the term of this patent is extended or adjusted under 35 U.S.C. 154(b) by 0 days.

(21) Appl. No.: 10/405,607

(22) Filed: Apr. 3, 2003

(65) Prior Publication Data

US 2003/0222933 A1 Dec. 4, 2003

(30) Foreign Application Priority Data

May 30, 2002 (KR) ..... 2002-30250

(51) Int. Cl.[7] ..... B41J 29/38
(52) U.S. Cl. ..... 347/17
(58) Field of Search ..... 347/14, 17, 189, 347/194; 219/494, 510

(56) References Cited

U.S. PATENT DOCUMENTS

| | | | | |
|---|---|---|---|---|
| 4,539,571 A | * | 9/1985 | Suzuki | 347/185 |
| 4,719,472 A | * | 1/1988 | Arakawa | 347/67 |
| 5,563,635 A | | 10/1996 | Kneezel et al. | 347/12 |
| 5,851,075 A | | 12/1998 | Imai | 400/120.14 |
| 6,102,515 A | * | 8/2000 | Edwards et al. | 347/17 |
| 6,231,154 B1 | | 5/2001 | Corrigan | 347/17 |

FOREIGN PATENT DOCUMENTS

| | | | | |
|---|---|---|---|---|
| EP | 0 300 634 | | 1/1989 | |
| EP | 435565 | A2 * | 7/1991 | ..... B41J/2/05 |
| EP | 0 694 394 | A1 | 1/1996 | |
| EP | 1 078 751 | A2 | 2/2001 | |

* cited by examiner

*Primary Examiner*—Lamson Nguyen
*Assistant Examiner*—Blaise Mouttet
(74) *Attorney, Agent, or Firm*—Staas & Halsey LLP

(57) ABSTRACT

A device for preventing a printer header from overheating includes a heater driving portion which is driven in response to a heater driving control signal, a heater emitting heat using electricity which is supplied by the heater driving portion, a substrate temperature detector detecting a temperature of a header substrate where the heater is mounted, a reference voltage generator generating a reference voltage, a comparator comparing a voltage detected by the substrate temperature detector with the reference voltage, a power control portion controlling a driving voltage supplied to the heater in response to a power control signal and controlling the driving voltage in accordance with an output signal of the comparator, and a control portion controlling the heater driving portion and the power control portion in accordance with transmitted printing data. According to the device for preventing the printer header from overheating, its hardware-like construction helps to prevent the header substrate from overheating even in a case that the overheating occurring in the header substrate is not controlled due to the abnormality of the control portion. Therefore, damage to the printer header is more efficiently prevented.

19 Claims, 2 Drawing Sheets

DEVICE FOR PREVENTING PRINTER HEADER FROM OVERHEATING

CROSS-REFERENCE TO RELATED APPLICATIONS

This application claims the benefit of Korean Patent Application No. 2002-30250, filed May 30, 2002, in the Korean Intellectual Property Office, the disclosure of which is incorporated herein by reference.

BACKGROUND OF THE INVENTION

1. Field of the Invention

The present invention relates to a printer, and more particularly, to a device for preventing a header of an ink-jet printer from overheating.

2. Description of the Related Art

An ink-jet printer is designed to produce a desired image on paper by ejecting ink onto the paper. The ink-jet printer includes a header providing ink to a plurality of nozzles through which the ink is ejected, and an electric circuit device that is designed to selectively operate the nozzles of the header according to printing data.

The ink-jet printer is classified into one of a piezo type printer and a bubble jet type printer by an ink discharging method. While the piezo type printer discharges the ink onto the paper by pressing an ink path, which the ink flows into, using a pressure element, the bubble jet type printer discharges the ink onto the paper by changing a volume of an ink drop which is formed by super-heating an ink discharge portion.

FIG. 1 is a view schematically showing a circuit of a general bubble jet type ink-jet printer. The ink-jet printer includes a printer system card 10 electrically controlling general operations of a system and a header 20 having a heater $R_H$ that emits heat to form an ink drop in response to a control signal and a driving voltage $V_{ph}$ transmitted from the printer system card 10.

The printer system card 10 includes a main process unit (MPU) 12 controlling the general operations of the system and a first transistor FET1 switching the driving voltage $V_{ph}$ to drive the heater $R_H$ of the header 20 under a control of the MPU 12. The header 20 has a second transistor FET2 that is driven by the control of the MPU 12, and the heater $R_H$ that emits the heat when the FET2 is driven. Generally, the heater $R_H$ consists of a resistance and is built in a substrate or a nozzle plate. Although FIG. 1 shows a single heater $R_H$ and a single FET2 corresponding to one ink discharging opening by way of example, all of ink discharging openings are individually provided with the heater $R_H$ and the transistor FET2.

In the bubble type ink-jet printer as constructed above, the MPU 12 drives the FET1 according to transmitted printing data to supply the driving voltage Vph to the heater $R_H$, and the MPU 12 also drives the FET2 such that the heater $R_H$ emits the heat. Accordingly, an ink drop is generated by the heater $R_H$ emitting the heat, and a volume of the ink drop becomes gradually larger. When the ink drop reaches a limit such that the ink drop does not become larger, the ink drop is pushed toward an ink discharging opening and discharged onto the paper. At this point, the ink is optimally discharged when a temperature of the ink is approximately 40° C. Therefore, the MPU 12 controls the FET2 supplying current electricity to the heater $R_H$ for a predetermined time to allow the substrate and the nozzle plate having the heater $R_H$ to reach the temperature of 40° C.

The general bubble type ink-jet printer heats the nozzle plate or the substrate at an optimum temperature under a normal condition, but it has a problem of overheating the heater under an abnormal condition, i.e., when there occurs an abnormality of the MPU in detecting the temperature. As the result, the nozzle plate or the substrate melts or overheats.

In order to solve the above problem, the MPU of the prior art detects a temperature of the header 20 through a temperature detecting unit and stops operating the FET1 shown in FIG. 1 to protect the header 20 from overheating when the detected temperature reaches a predetermined temperature.

However, the above conventional method of preventing the header from overheating using a software-like process still has a problem in that the substrate or the nozzle plate is overheated when an abnormality occurs in detecting the temperature.

SUMMARY OF THE INVENTION

The present invention has been developed in order to solve the above and other problems in the related art. Accordingly, it is an object to provide a device for preventing a printer header from overheating by protecting the printer header using a hardware-like method.

Additional objects and advantageous of the invention will be set forth in part in the description which follows and, in part, will be obvious from the description, or may be learned by practice of the invention.

In order to achieve the above and other objects, a device for preventing a printer header from overheating according to an aspect of the present invention includes a heater driving portion which is driven in response to a heater driving control signal, a heater emitting heat using electricity which is supplied by the heater driving portion, a substrate temperature detector detecting a temperature of a header substrate where the heater is mounted, a reference voltage generator generating a reference voltage, a comparator comparing a voltage detected by the substrate temperature detector with the reference voltage, a power switching portion switching a driving voltage supplied to the heater in response to a power control signal and controlling the driving voltage in accordance with an output signal of the comparator, and a control portion controlling the heater driving portion and the power switching portion in accordance with transmitted printing data.

According to an aspect of the present invention, the heater is disposed in a nozzle plate of the header, and the substrate temperature detector may be a nozzle plate temperature detector detecting a temperature of the nozzle plate.

According to another aspect of the present invention, the base and nozzle plate temperature detectors use a thermistor, and the heater driving portion and the power switching portion use a field effect transistor.

The device for preventing the printer header from overheating according to another aspect of the present invention blocks the driving voltage to be supplied to the heater forcedly according to the output signal of the comparator when there occurs an overheating in the substrate or the nozzle plate, thereby preventing the header from overheating.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
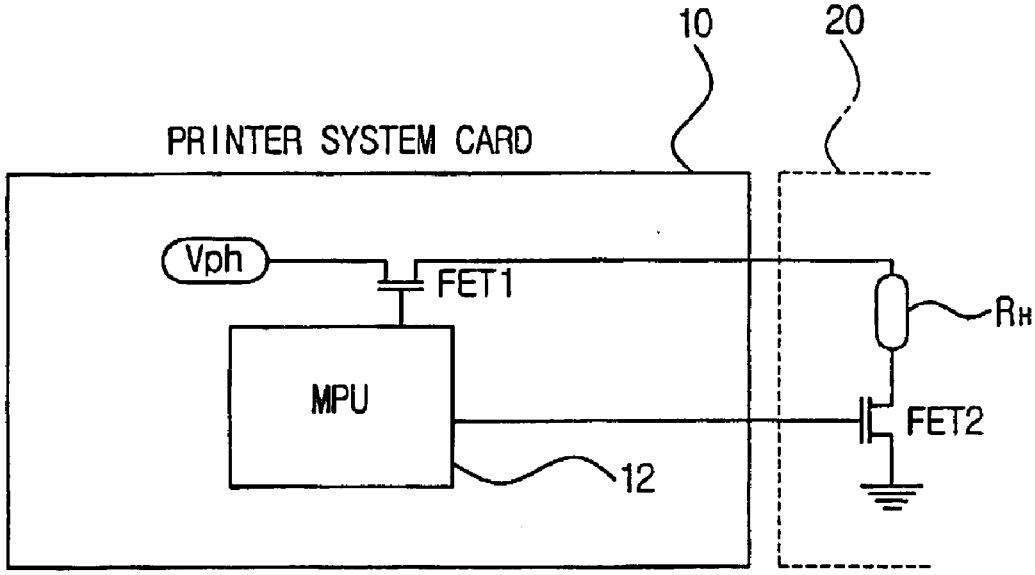
FIG. 1 (PRIOR ART)
FIG. 1 is a circuit diagram showing a header and a printer system card of a general ink-jet printer.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Hereinafter, the present invention will be described in greater detail with reference to the accompanying drawing.

Figure 2:
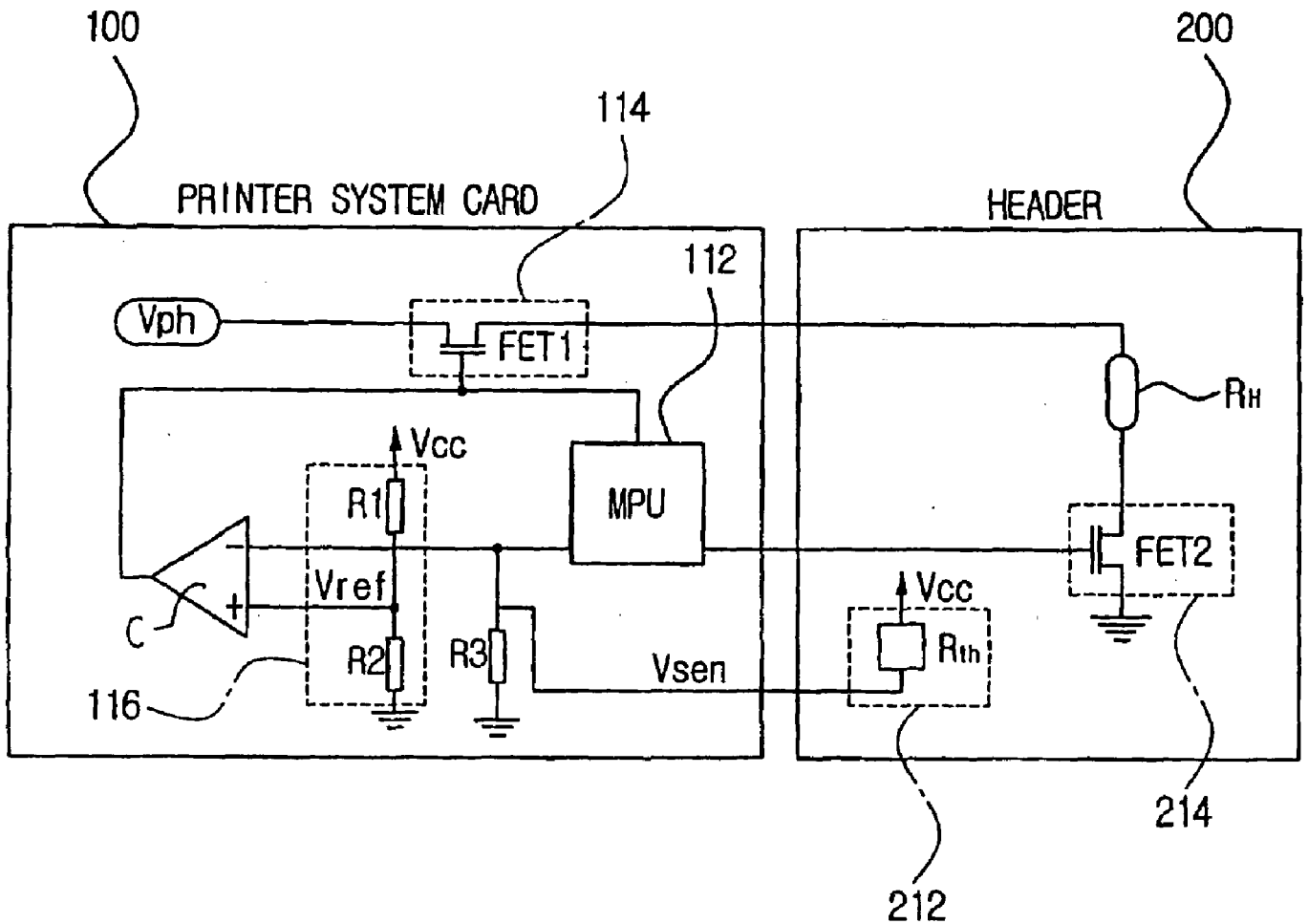
FIG. 2 is a circuit diagram for a device for preventing a printer header from overheating in an ink-jet printer according to an embodiment of the present invention.

FIG. 2 is a circuit diagram showing a device for preventing a printer header 200 from overheating in an ink-jet printer according to an embodiment of the present invention. The ink-jet printer includes a printer system card 100 controlling general operations of a system and selectively operating a heater $R_H$, which is disposed in a header substrate, according to a transmitted printing data, and the printer header 200 having the heater $R_H$ that emits heat according to a control signal transmitted from the printer system card 100 and having a structure of ejecting ink onto paper.

The printer system card 100 includes an MPU 12, a comparator, a power switching portion (FET1) 114, and a reference voltage generator 116. In the printer header 200 are provided the heater $R_H$, a heater driving portion (FET2) 214, and a substrate temperature detector 212. At this point, the power switching portion 114 and a heater driving portion 214 use a field effect transistor (FET), and the substrate temperature detector 212 uses a thermistor (Rth). The FET is only one example out of many, and various switching elements can be used instead of the FET. Also, various temperatures detector can be used instead of the thermistor. The heater driving portion 214 may be disposed in the printer header 200 or outside the printer header 200.

The MPU 112 of the printer system card 100 controls the general operations of the system and controls a supplying operation of a driving voltage Vph to the heater $R_H$ disposed in a header substrate through the power switching portion (FET1) 114. The MPU 112 also controls a driving operation of the heater $R_H$ through the heater driving portion (FET2) 214. The MPU also controls the power switching portion (FET1) 114 according to a temperature of the header substrate of the printer header 200 detected by the thermistor Rth. For detailed explanation, the thermistor Rth is an element that its resistance value is changed according to the temperature of the header substrate. That is, when the temperature of the header substrate increases, the resistance value of the thermistor Rth decreases such that a high voltage is output from the substrate temperature detector 12. When the temperature of the header substrate decreases, the resistance value increases such that a low voltage is output from the substrate temperature detector 12.

Meanwhile, the thermistor Rth disposed in the header is connected with an input port of the MPU 112 and an inverting terminal (−) of the comparator C. A reference voltage output node of the reference voltage generator 116 comprising a first resistance R1 and a second resistance R2 is connected to a non-inverting terminal (+) of the comparator C. An output terminal of the comparator is connected to a gate of the power switching portion (FET1).

When the printer having the device for preventing the printer header 200 from overheating as described above receives printing data, the MPU 112 controls the power switching portion (FET1) 114 and the heater driving portion (FET2) 214 to supply the driving voltage Vph to the heater $R_H$ for a predetermined time. When the heater $R_H$ emits heat and the temperature of the substrate increases, the MPU 112 turns off the power switching portion (FET1) 114, and ink is supplied for printing. The MPU 112 continuously detects the temperature of the header substrate by the thermistor Rth during an operation of the heater $R_H$. If the MPU 112 detects that the heater $R_H$ overheats, the MPU 112 controls the power switching portion (FET1) 114.

Meanwhile, the comparator C receives a detection voltage Vsen, which is distributed (divided) by a third resistance R3 and a resistance of the thermister Rth, and a reference voltage Vref, which is generated by the reference voltage generator 116, through the inverting terminal (−) and the non-inverting terminal (+), respectively, and then outputs the high voltage or the low voltage to the gate of the power switching portion (FET1) 114 according to a detection voltage Vsen. That is, if the detection voltage Vsen is higher than the reference voltage Vref, the comparator outputs the low voltage to the gate of the power switching portion (FET1) 114 and switches the driving voltage Vph to be supplied to the heater $R_H$. If the detection voltage Vsen is lower than the reference voltage Vref, the comparator outputs the high voltage to the gate of the power switching portion (FET1) and blocks the driving voltage Vph from being supplied to the heater $R_H$. After that, if the temperature of the header substrate decreases, the comparator C returns to outputting the low voltage and re-operates the power switching portion (FET1).

According to the present invention, the printer having the device for preventing the printer header from overheating controls the driving voltage Vph to be supplied to the heater $R_H$ by the MPU 112 when the overheating of the printer header occurs in the printer, and the device for preventing the printer header from overheating prevents the header substrate from overheating by its hardware-like construction.

Meanwhile, although the printer heater $R_H$ is mounted in the header substrate of the printer header in this embodiment, this should not be considered as limiting. That is, the device for preventing the printer header from overheating of the present invention can be applied to a printer that has a heater $R_H$ mounted in a nozzle plate of a printer header.

According to the device for preventing the printer header from overheating of the present invention, the hardware-like construction helps to prevent the header substrate from overheating even in a case that the overheating occurring in the header substrate is not controlled due to the abnormality of the MPU 112. Therefore, damage to the printer header is more efficiently prevented.

Although the preferred embodiment of the present invention has been described, it is understood that the present invention should not be limited to this preferred embodiment but various changes and modifications can be made by one skilled in the art within the spirit and scope of the present invention as hereinafter claimed and their equivalents.

What is claimed is:

1. A device for preventing a printer header from overheating, comprising:

a control portion generating a heater driving control signal and a power control signal;

a heater driving portion which is driven in response to the heater driving control signal;

a header base plate including a heater emitting heat using electricity which is supplied by the heater driving portion;

a base plate temperature detector detecting a temperature of the header base plate to output a detection voltage;

a reference voltage generator generating a reference voltage;

a comparator comparing the detection voltage detected by the base plate temperature detector with the reference voltage; and a power switching portion switching a driving voltage to be supplied to the heater in response to the power control signal and controlling the driving voltage in accordance with an output signal of the comparator, wherein the control portion controls the heater driving portion to generate a power control signal so as to control the power switching portion and the heater driving portion not to drive the heater in accordance with the detection voltage, and to control the power control portion not to supply the power voltage to the heater when the detection voltage is higher than a reference voltage regardless of the power control signal.

2. The device of claim 1, wherein the header base plate comprises:

a nozzle plate.

3. The device of claim 1, wherein the base plate temperature detector comprises:

a thermister.

4. The device of claim 1, wherein the heater driving portion and the power switching portion comprises:

a field effect transistor.

5. A device for preventing a printer header from overheating, comprising:

a heater disposed in the printer header;

a heater driving portion driving the heater;

a power switching portion supplying a power voltage to the heater;

a temperature detector detecting a temperature of the printer header and generating a detection voltage; and a control portion to control the heater driving portion, to generating a power control signal to control the power switching portion and the heater driving portion not to drive the heater in accordance with the detection voltage, and to control the power control portion not to supply the power voltage to the heater when the detection voltage is higher than a reference voltage regardless of the power control signal.

6. A device for preventing a printer header from overheating, comprising:

a heater disposed in the printer header;

a heater driving portion driving the heater;

a power switching portion supplying a power voltage to the heater;

a temperature detector detecting a temperature of the printer header and generating a detection voltage;

a control portion generating a driving control signal to control the heater driving portion and generating a power control signal to control the power switching portion in accordance with the detection voltage;

a reference voltage generator generating a reference voltage; and a comparator connected between the temperature detector and the power switching portion to compare the detection voltage with the reference voltage and to output a control voltage to the power switching portion and the control portion.

7. The device of claim 6, wherein the control portion controls the heater driving portion and the power control portion in accordance with the control voltage.

8. The device of claim 6, wherein the power switching portion stops supplying the power voltage to the heater in response to the control voltage, and the control portion controls the heater driving portion not to drive the heater in response to one of the control voltage and the detection voltage when the detection voltage is higher than the reference voltage.

9. The device of claim 6, wherein the power switching portion does not supply the power voltage to the heater in response to receiving one of the control voltage from the comparator and the power control signal from the control portion, and the heater driving portion does not drive the heater in response to receiving the driving control signal from the control portion.

10. The device of claim 6, wherein the heater driving portion and the power switching portion each comprise a transistor having a gate, and the comparator comprises:

an output terminal connected to the gate of the transistor of the power switching portion.

11. The device of claim 10, wherein the control portion is connected to the output terminal of the comparator to receive the control voltage and controls the heater driving portion to drive the heater in response to the control voltage.

12. The device of claim 10, wherein the control portion controls the heater driving portion in response to one of the detection voltage and the control voltage.

13. The device of claim 10, wherein the comparator comprises:

a first input terminal connected to the temperature detector to receive the reference voltage; and a second input terminal connected to the reference voltage generator to receive the detection voltage.

14. The device of claim 13, wherein the temperature detector is connected to the control portion and the first input terminal.

15. The device of claim 10, wherein the control portion is connected to the temperature detector to receive the detection voltage, and the control portion controls the power switching portion in response to the detection voltage.

16. The device of claim 10, wherein the control portion controls the heater driving portion in response to one of the detection voltage of the temperature detector and the control voltage of the comparator.

17. The device of claim 10, wherein the power switching portion stops supplying the power voltage to the heater in response to one of the power control signal of the control portion and the control voltage of the comparator.

18. A method in a device for preventing a printer header from overheating in a printer, the method comprising:

generating a driving control signal and a power control signal;

driving a heater formed in a base plate in response to the driving control signal;

supplying a power voltage to the heater in response to the power control signal;

causing the heater to generate heat in accordance with the driving of the heater and the supplying of the power voltage;

detecting a temperature of the base plate corresponding to the heat to generate a detection voltage;

generating a reference voltage;

comparing the detection voltage with the reference voltage to generate a control voltage;

switching the power voltage to a second power voltage to be to be supplied to the heater in response to the control voltage; and terminating the supplying of the power voltage to the heater in response to the control voltage regardless of the power control signal.

19. The method of claim 18, wherein the switching of the power voltage comprises:

terminating the driving of the heater in response to the control voltage.

* * * * *

UNITED STATES PATENT AND TRADEMARK OFFICE

CERTIFICATE OF CORRECTION

PATENT NO. : 6,860,577 B2
DATED : March 1, 2005
INVENTOR(S) : Kyung-chool Choi

It is certified that error appears in the above-identified patent and that said Letters Patent is hereby corrected as shown below:

Column 6,
Line 58, delete "to be", second occurrence.

Signed and Sealed this

Sixth Day of December, 2005

JON W. DUDAS
*Director of the United States Patent and Trademark Office*